United States Patent [19]

Hudelmaier

[11] Patent Number: 4,478,514

[45] Date of Patent: Oct. 23, 1984

[54] VIBRATING CONCRETE MIXER

[75] Inventor: Gerhard Hudelmaier, Ulm, Fed. Rep. of Germany

[73] Assignee: Ingrid Hudelmaier, Ulm, Fed. Rep. of Germany

[21] Appl. No.: 468,576

[22] Filed: Feb. 22, 1983

[51] Int. Cl.[3] ..... B28C 5/20; B28C 7/12

[52] U.S. Cl. ..... 366/2; 366/40; 366/59; 366/119; 366/167

[58] Field of Search ..... 366/2, 3, 6, 12, 30, 366/40, 59, 119, 167, 170, 175

[56] References Cited

U.S. PATENT DOCUMENTS

| | | | |
|---|---|---|---|
| 2,192,406 | 3/1940 | Ludington | 366/40 |
| 2,226,104 | 12/1940 | Viall | 366/59 X |
| 2,413,488 | 12/1946 | Draeger | 366/40 |
| 2,533,191 | 12/1950 | Jaeger | 366/40 X |
| 2,537,585 | 1/1951 | Hilkemeier | 366/40 |
| 2,687,286 | 8/1954 | Eickstaedt | 366/59 X |

FOREIGN PATENT DOCUMENTS

| | | | |
|---|---|---|---|
| 879199 | 10/1961 | United Kingdom | 366/30 |
| 257322 | 4/1970 | U.S.S.R. | 366/40 |

*Primary Examiner*—Philip R. Coe

*Attorney, Agent, or Firm*—Christie, Parker & Hale

[57] ABSTRACT

A concrete mixer having a drum, which contains mixing elements, and at least one vibrator for imparting vibrational energy to the material which is to be mixed. The vibrator is drivable by means of the water used to make up the concrete. The water may be discharged in a pulsating manner from a vibrating body which is caused to vibrate by this pulsation, or it may rotatably drive an eccentric mass in the vibrating body.

18 Claims, 12 Drawing Figures

VIBRATING CONCRETE MIXER

BACKGROUND OF THE INVENTION

The invention relates to a concrete mixer, and more particularly, to a concrete mixer employing vibrations to aid the mixing action.

A mixer of this type is known from U.S. Pat. No. 4,148,588. The rotatable drum for producing concrete which is found in this mixer has supply openings on its top, into which a fluid charge containing the concrete ingredients is introduced. The mixing process is improved by means of vibrators, which are each excited via unbalanced mass motors on a vibrating plate. Because of the disposition of the oscillating plate and because of the unbalanced mass motors, the mixer is expensive in terms of its structure. Its energy requirement furthermore appears to be relatively high.

The same is true of a mixer such as that known from German laid open application 2,425,158. The mixer is filled from the top and the finished, mixed product is removed at the bottom. From the bottom, a shaft which is driven for rotation protrudes into the drum. The shaft has elastic laminations as mixing elements. A number of shaker elements are also disposed in the vicinity of the interior drum wall. The part of each shaker element which acts directly upon the material being mixed comprises a plate which is adapted to the curvature of the mixing vessel wall and which overlaps a corresponding opening in the wall from the inside of the mixer. This plate is connected with the wall via an elastic intermediate wall, which covers the opening and is simultaneously intended to prevent the transmission of the shaking action to the vessel wall. Each plate has its own drive means in the form of an electric unbalanced mass shaker, which is located outside the mixing vessel. This known mixer is extremely expensive structurally because of the required openings in the drum wall, the precise adaptation of the shaker plate shape and the associated seals, as well as the need for a plurality of separate unbalanced mass shaker elements. It is doubtful that the described effect of the shaking action on the material being mixed is in fact attained. Further disadvantages are the significant tendency to breaking down, because the elastic seal is encountered by the material being mixed and becomes corroded with time; also, transmission of the shaking action to the drum cannot be prevented by the seal, so that the mixing vessel and its bearing, like the mixer shaft, are subjected to increased wear. Driving a plurality of shaker elements (four in the exemplary embodiment) also necessitates a relatively high expenditure of additional energy.

SUMMARY OF THE INVENTION

In a mixer of the above-described general type, vibrations are imparted to a concrete mixture by means that is simple in structure, economical in its energy requirements and capable of attaining effective mixing. Specifically, mixing water constituent of the concrete provides the energy for the vibrations; either the mixing water is itself directed at the concrete mixture in pulses by means of a pulsating pump, or the mixing water itself drives a pulsator or a turbine on which an unbalanced mass is mounted. The water required for mixing is in any event supplied to the interior of the drum. Accordingly, the lines, seals and connections required therefor do not occasion any additional expense. It has been demonstrated with surprising effect that the time during which the mixing water is introduced also suffices as a vibration period for attaining the desired mixing effect.

Imparting the necessary vibrational energy by means of water may take place in various ways according to the invention. The pulsations may be induced in the mixing water either outside the drum or inside. The mixing water issuing from the water supply device may transfer its vibrational energy directly to the concrete mixture or indirectly by driving a mechanical vibrator.

BRIEF DESCRIPTION OF THE DRAWINGS

The features of specific embodiments of the best mode contemplated of carrying out the invention are illustrated in the drawings, in which FIGS. 1–12, respectively, illustrate schematically various embodiments of a mixer according to the invention.

DETAILED DESCRIPTION OF THE SPECIFIC EMBODIMENTS

Figure 1:
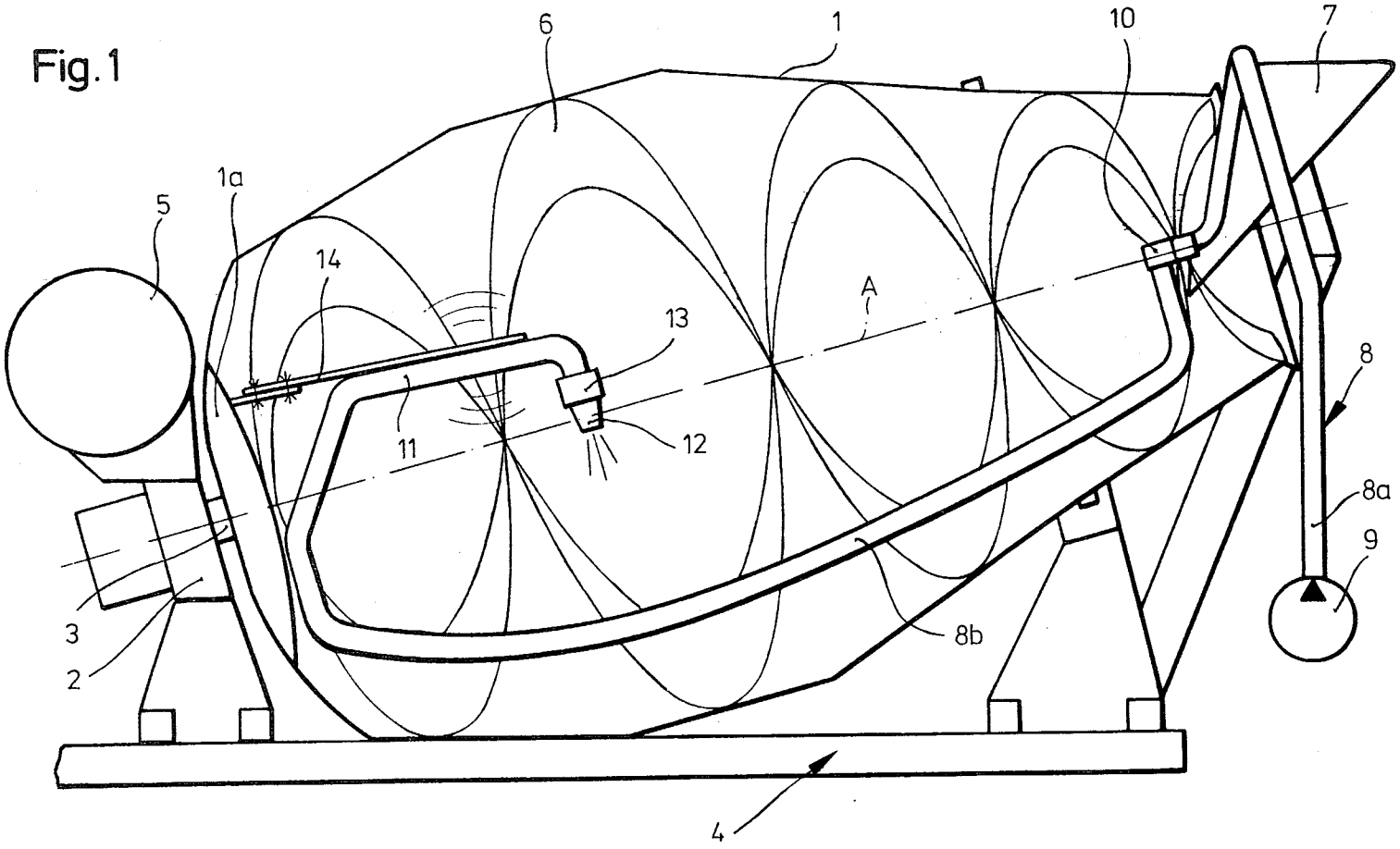

The concrete mixer shown in FIG. 1 has a drum 1, which is rotatably supported in a bearing block 2 by means of a shaft 3. The drum 1 and the bearing block 2 are supported on a frame identified as a whole by reference numeral 4. The frame 4 may be disposed in a stationary manner or it may be part of a movable, transportable concrete mixer. A water tank 5 is also held in position in the vicinity of the bearing block 2. The drum 1 has symmetry about a longitudinal axis of rotation A, which lies at an acute angle to the horizontal.

The drum 1, which for illustration purposes is shown as open at the top, has a mechanical mixing element 6 in its interior in the form of a blade or blades extending spirally along the inner wall over the entire length of the drum concentrically with axis A. At the top opening of the drum, there is a filler receiving trough 7. A water supply line (conduit) identified as a whole by reference numeral 8 also enters into the drum 1 in the vicinity of its top opening. The portion **8*a* of the water line located outside the drum 1 contains a pump 9 for the supply of water. For the sake of simplicity, the connection between the pump 9 and the water tank 5 is not shown. The portion 8*a* of the water line located outside the drum 1 is connected at a point on axis A in the vicinity of the top opening of the drum to the portion 8*b* of the water line located inside the drum via a rotary coupling 10. The portion 8*b* of the water line located inside the drum 1 extends to the vicinity of the drum floor 1*a*, and there it is bent back again toward the top of the drum. The final section of the water line portion 8*b* forms a pipe section 11, which extends approximately parallel to axis A of the drum. On its free end and at right angles to axis A, there is an exit for the water in the form of an outlet nozzle 12. A pulsator 13 which causes a pulsed discharge of the water from the exit is disposed between the outlet nozzle 12 and the pipe section 11. The pipe section 11, which is elastically supported via the bent portion of the water line portion 8*b*, is thereby set to vibrating. These vibrations are damped by a resilient support 14, which extends from the drum floor 1*a* to the pipe section 11. Water line portion 8*b* is connected by support 14 to drum 1 and rotates therewith, while water line portion 8*a*** is unconnected thereto and remains stationary.

The concrete mixture described above operates as follows:

Via the trough 7, the dry ingredients of the concrete are fed into the rotating drum and mixed well by the mixing elements 6. At the same time, the mixing water required for producing the concrete is supplied via the water supply line 8. The water flows in pulsed fashion out of the outlet nozzle 12 against the mixture of constituents, and this action induces vibrations in the mixture. The pulsed discharge of water furthermore causes the pipe section 11 to vibrate. This vibration is also transmitted to the mixture in the vessel surrounding the pipe section 11. The internal friction of the material being mixed is reduced thereby to such an extent that the mixing effect of the rotating drum 1 and the mixing element 6 is increased and the mixing time is reduced accordingly.

Figure 2:
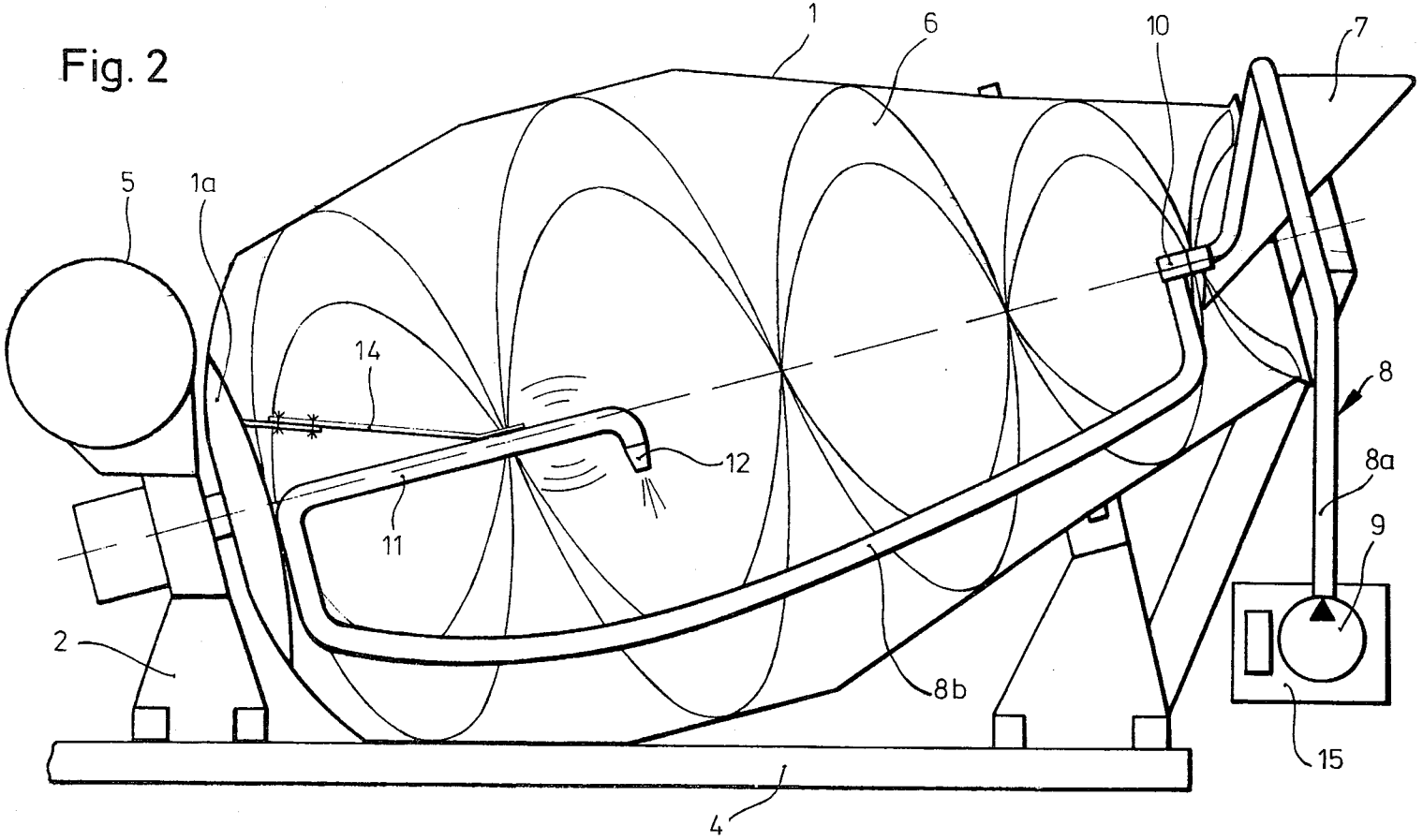

FIG. 2 shows an embodiment of a mixer which is substantially equivalent to the embodiment of FIG. 1. The component parts are therefore identified by the same reference numerals. Thus here and in the remaining exemplary embodiments only their respective differences will be discussed. The concrete mixer shown in FIG. 2 has, in addition to the pump 9 for supplying the water, a pressure-increasing arrangement 15 for a pulsating medium. This may be, by way of example, a piston pump, a diaphragm pump or a spiral pump. In the embodiment according to FIG. 2, the pressure increasing arrangement is combined with pump 9 into a single component outside drum 1. Thus, no pulsator 13 is now provided in the vicinity of the outlet nozzle 12, but water pulses are emitted from nozzle 12 and pipe section 11 vibrates as described in connection with FIG. 1.

Figure 3:
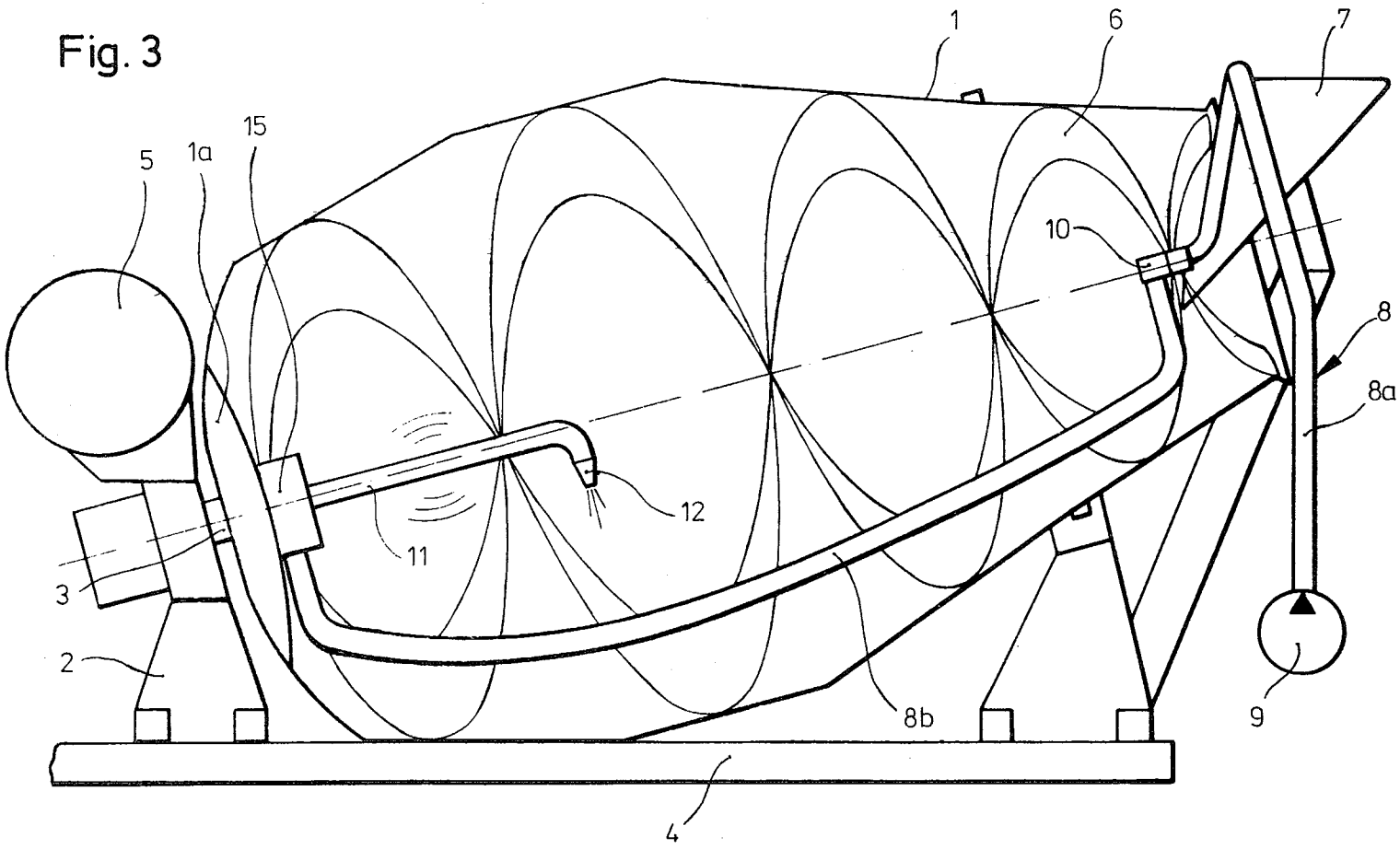

The concrete mixer shown in FIG. 3 differs from that shown in FIG. 2 in that the pressure increasing arrangement 15 is not disposed outside the drum 1 in the vicinity of the pump 9, but instead is incorporated into the water line portion 8*b* inside the drum 1 in the vicinity of the drum floor 1*a*. The required power line is fed into drum 1 in a manner not shown, in the vicinity of the bearing for the shaft 3. Vibrations are transferred to the mixture in the two ways described above.

Figure 4:
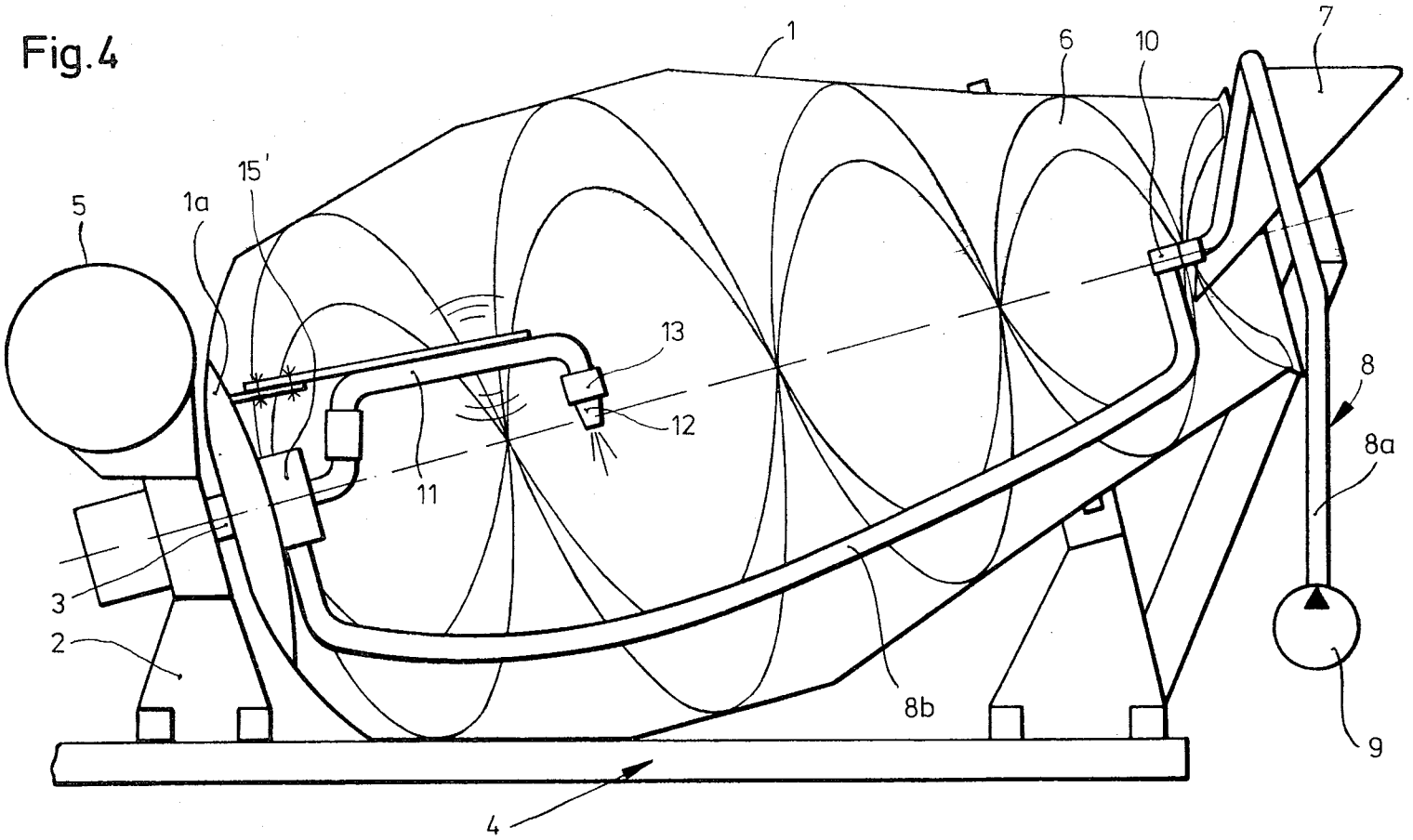

The concrete mixer of FIG. 4 has a pressure increasing arrangement 15' in the vicinity of the drum floor 1*a*; however, this system only increases the water pressure, while a pulsator 13 is additionally disposed in the vicinity of the outlet nozzle 12. Otherwise, this embodiment is as FIG. 3.

Figure 5:
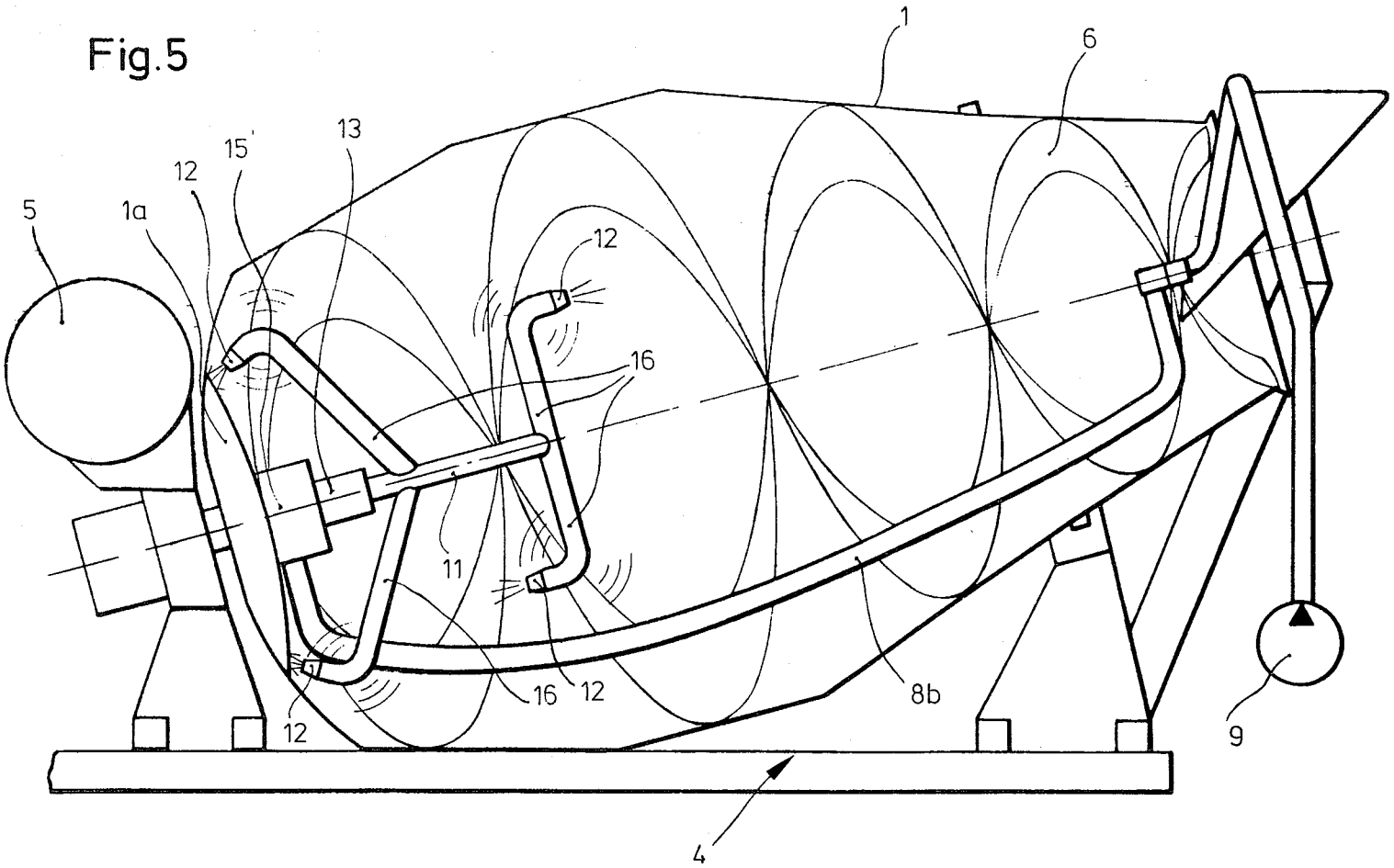

FIG. 5 shows a pressure increasing arrangement 15' in the vicinity of the drum floor 1*a* and a pulsator 13 of its own, disposed following it in the flow direction of the water. However, in this embodiment of the mixer, the elastic pipe section 11 is provided with arms 16 which in turn carry outlet nozzles 12. Because a pulsed discharge of water is effected from each of the outlet nozzles 12 by means of the pulsator 13, each of the arms 16 is itself a vibrator, analogous to the arrangement of FIG. 2.

Figure 6:
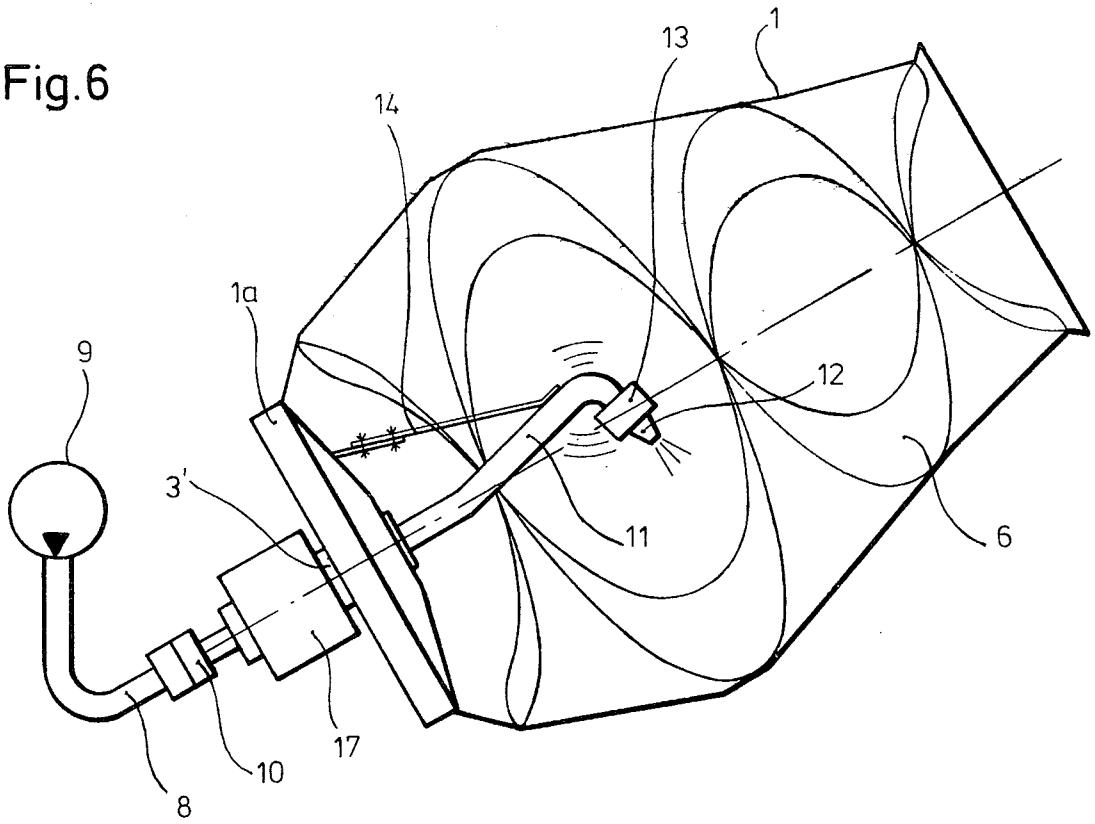
Figure 7:
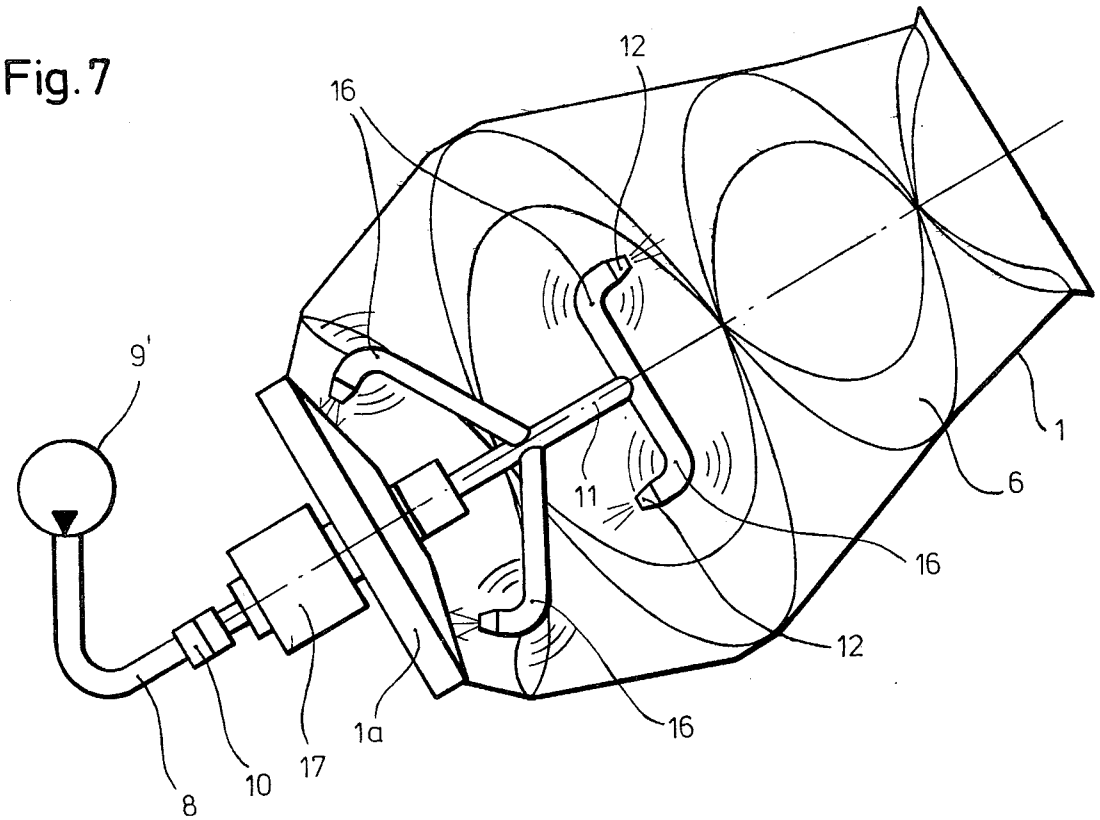
Figure 8:
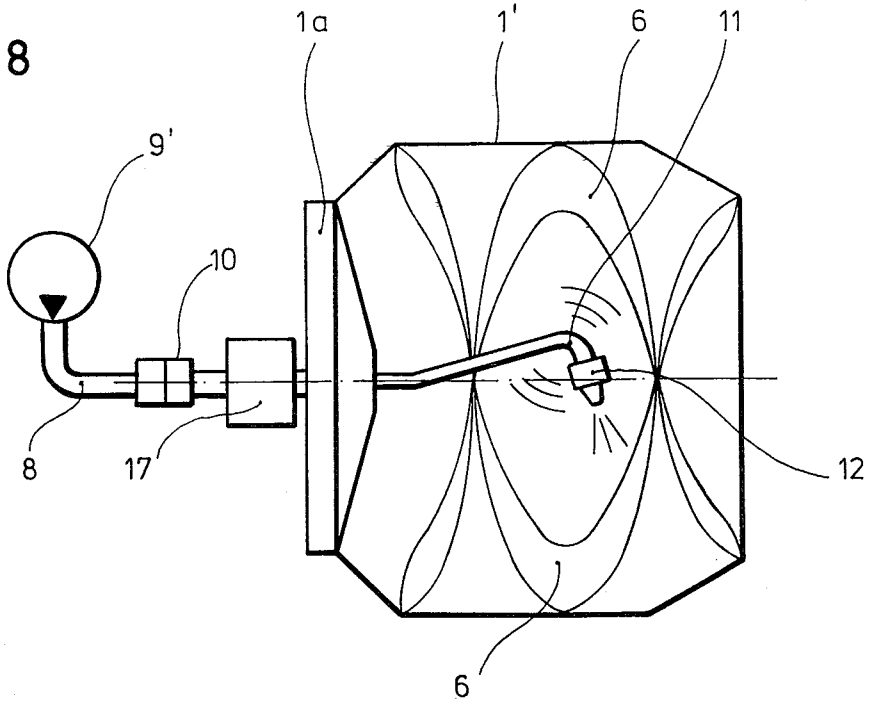

FIGS. 6–8 show drums 1 without their support means and with vibrator embodiments substantially as what has already been shown in the foregoing embodiments. The same reference numerals are therefore used for elements which are the same, or nearly the same. The substantial difference between these embodiments and what has been described above is that the water supply line 8 passes through the drum floor 1*a* directly into the pipe section 11. The water supply line 8 thereby passes through the drum drive means 17 and the shaft 3', which in this case is hollow. A rotary coupling 10 is inserted into the water supply line 8 preceding the drum drive means.

In FIG. 6, the elastic pipe section 11 of FIG. 1 is equipped with a pulsator 13 directly before the outlet nozzle 12. A resilient support 14 extends between the drum floor 1*a* and the pipe section 11. The water is supplied by a standard pump 9.

In the embodiment shown in FIG. 7, arms 16 which proceed from the elastic pipe section 11 act as the vibrators, in fashion similar to FIG. 5. The water supply is furnished by the pump 9' in pulsating form.

In FIG. 8, the drum 1' is an embodiment intended for a gravity feed mixer. A further difference from the form of embodiment shown in FIG. 6 is that in FIG. 8, no resilient support 14 is provided.

Figure 9:
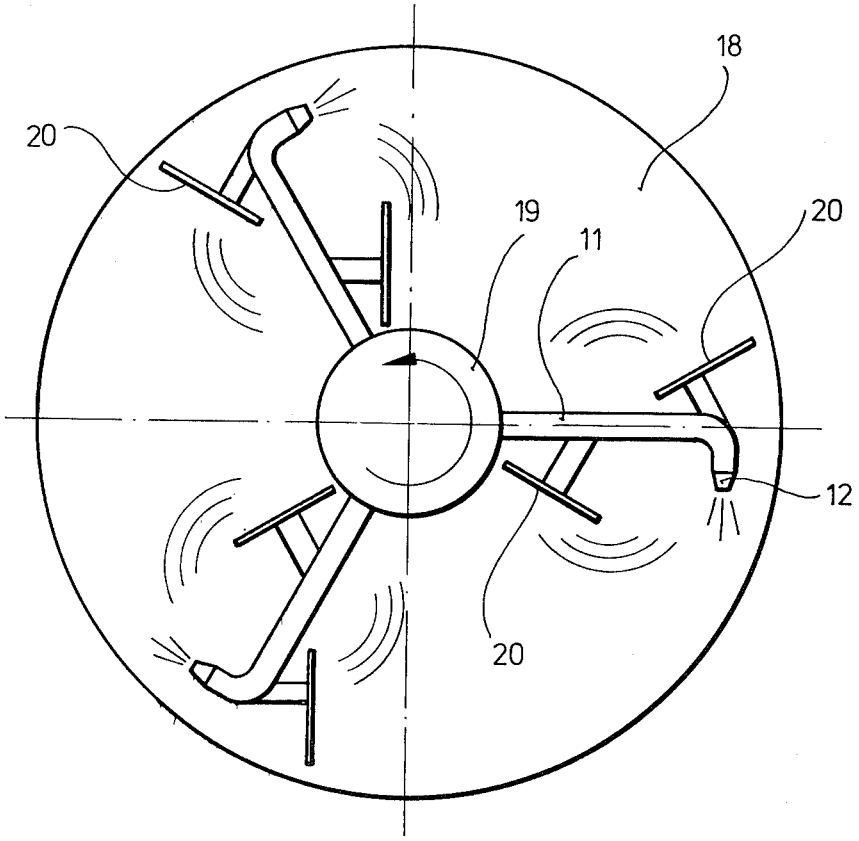
Figure 10:
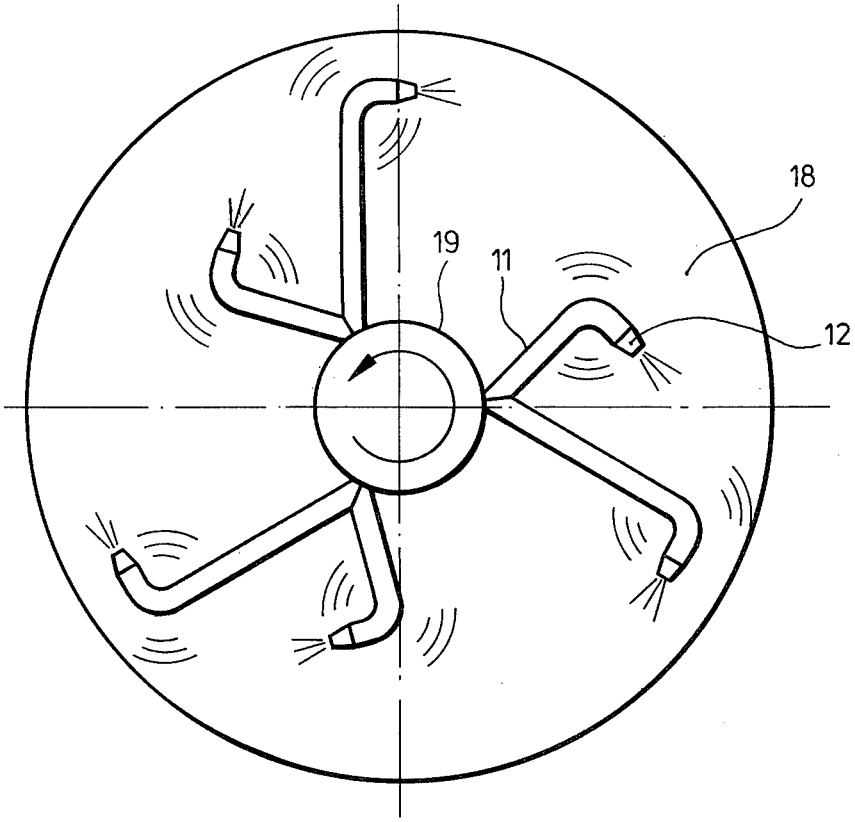

FIGS. 9 and 10 each provide a plan view of a plate 18 of a plate type mixer. Elastic pipe sections 11 having outlet nozzles 12 bent at a right angle serve as the vibrators, as in the foregoing embodiments. They are supplied with mixing water, which is delivered such that it is pulsating, and caused to vibrate by the water discharge in a manner not shown. In contrast to the other embodiments, the pipe sections 11 are attached to a central rotary body 19, which is drivable for mixing purposes. In the form of embodiment shown in FIG. 9, mixing tools 20 are also connected to the pipe sections 11. In the form of embodiment shown in FIG. 10, only the pipe sections 11 are supported on the rotary body 19.

Figure 11:
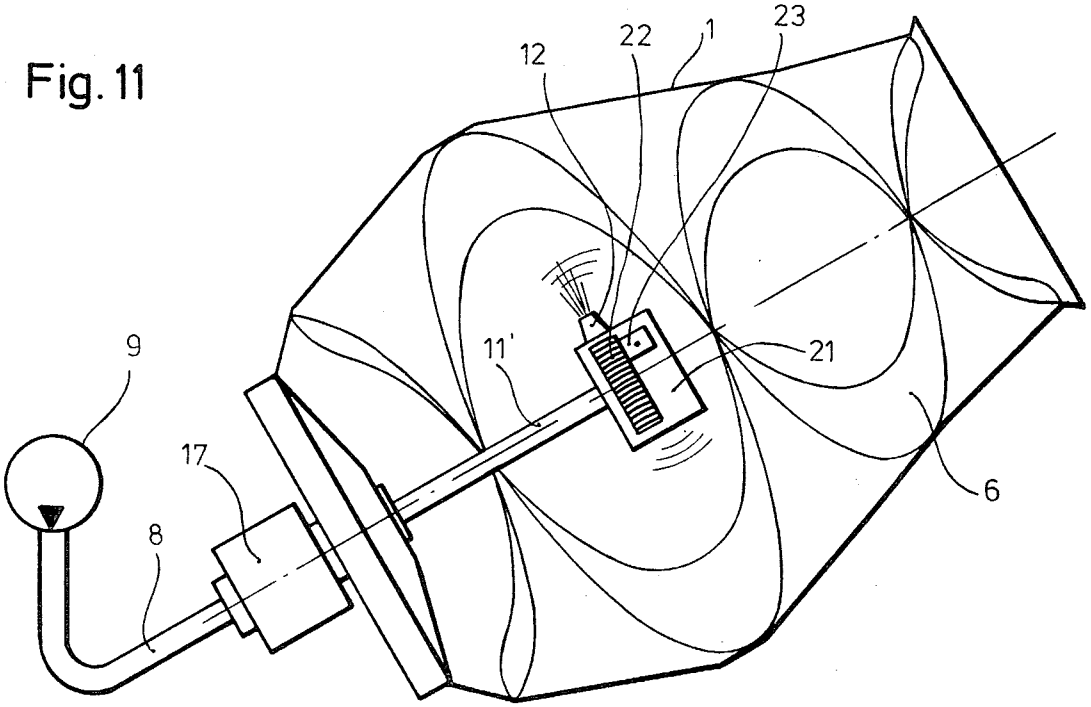
Figure 12:
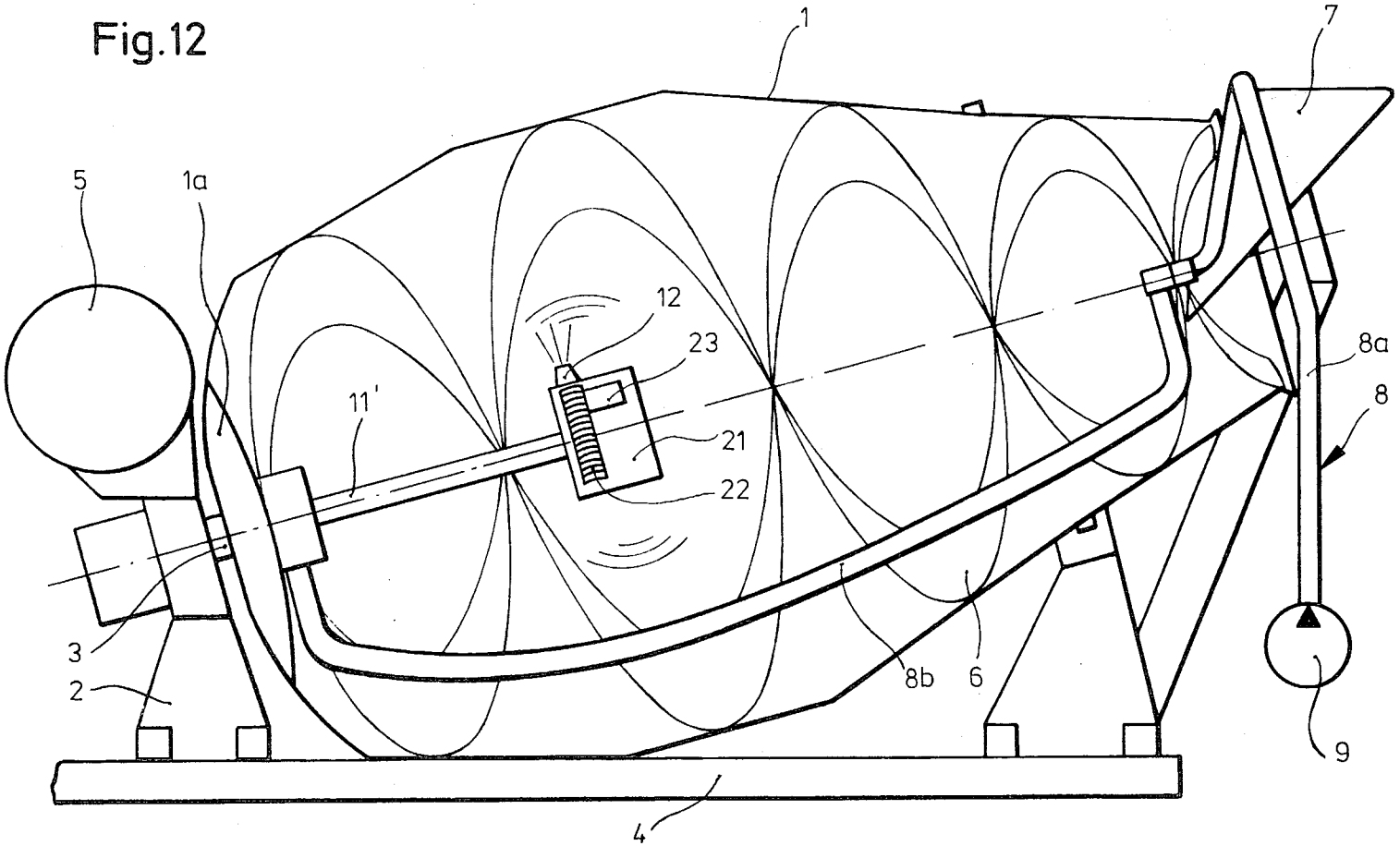

In FIGS. 11 and 12, drums 1 are shown which are for the most part identical to those of the foregoing embodiments. All the structural components which are identical or nearly so are accordingly provided with the same reference numerals. An important difference is in the type of vibrators and their drive means. The mixing water is delivered in the manner already described, by means of a pump 9, via the water supply line 8 to a pipe section 11' elastically supported on the drum floor 1*a*. The pipe section 11', on its end remote from the drum floor, carries an elastic, i.e., vibratable, turbine housing 21 with a turbine wheel 22. An unbalanced mass 23 is mounted on the turbine wheel 22. The mixing water causes the turbine wheel 22 to rotate, as a result of which the unbalanced mass 23 induces the turbine housing and thus the pipe section 11' to vibrate. The mixing water leaves the turbine housing 21 through an outlet nozzle 12 disposed laterally on the turbine housing. Thus, the mixing water itself energized by pump 9, provides the energy to turbine wheel 22 that rotates unbalanced mass 23. Mass 23 then generates vibrations transferred to the concrete mixture by housing 21 and/or pipe section 11'.

What is claimed is:

1. A concrete mixer comprising:
a rotatable drum;
means for rotatably driving the drum about an axis of rotation;
a water conduit having an entrance outside the drum and an exit inside the drum; and
means responsive to water flowing through the conduit to the exit for transferring vibrations to the inside of the drum.

2. The concrete mixer of claim 1, in which the vibration transferring means comprises means for emitting from the exit of the conduit pulses of water.

3. The concrete mixer of claim 2, in which the vibration transferring means additionally comprises a mechanical vibrator responsive to water flowing through the conduit.

4. The concrete mixer of claim 1, in which the vibration transferring means comprises a mechanical vibrator responsive to water flowing through the conduit.

5. The concrete mixer of claim 1, in which the drum has symmetry about the axis of rotation, an opening at its top, and a floor at its bottom.

6. The concrete mixer of claim 5, in which the axis of rotation forms an acute angle with the horizontal.

7. The concrete mixer of claim 6, additionally comprising a mechanical mixing element in the drum.

8. The concrete mixer of claim 7, in which the mixing element comprises a spiral blade extending along the entire length of the drum coaxially with the axis of rotation.

9. The concrete mixer of claim 1, in which the conduit leads from its entrance into the drum through its opening.

10. The concrete mixer of claim 9, in which the conduit passes through the axis of rotation at a point near the opening of the drum, the concrete mixer additionally comprising a rotary coupling at said point, and means for connecting the portion of the conduit between the rotary coupling and the exit to the drum to rotate therewith, the portion of the conduit between the rotary coupling and the entrance being unconnected to the drum.

11. The concrete mixer of claim 10, in which the connected portion of the conduit extends from the point near the opening of the drum to the floor of the drum and bends back toward the opening of the drum along the axis of rotation to the exit and the connecting means comprises a resilient support between the conduit near the exit and the floor of the drum to damp oscillations.

12. The concrete mixer of claim 1, additionally comprising a pump connected to the conduit to increase the pressure of water passing therethrough.

13. The concrete mixer of claim 12, in which the pump is located at the entrance of the conduit.

14. The concrete mixer of claim 12, in which the pump is located at the floor of the drum.

15. The concrete mixer of claim 1, in which the conduit has a plurality of arms in the drum and the exit comprises openings from the arms for emitting water into the drum.

16. The concrete mixer of claim 15, additionally comprising mixing blades on the arms.

17. The concrete mixer of claim 1, in which the conduit passes into the drum through its floor concentrically with the axis of rotation.

18. A method for mixing concrete constituents in a drum comprising the steps of:

introducing the dry concrete constituents into the drum;

separately introducing the water constituent into the drum; and converting some of the energy of the water being introduced into the drum into vibrations in an elastic member in contact with the constituents to promote mixing thereof.

* * * * *